US005417392A

United States Patent [19]

Wyatt

[11] Patent Number: 5,417,392

[45] Date of Patent: May 23, 1995

[54] HYDRAULIC SWITCH STAND WITH RAIL PUMP CHARGING AND HYDRAULIC LOCK

[76] Inventor: Michael L. Wyatt, P.O. Box 2721, Paducah, Ky. 42002

[21] Appl. No.: 142,611

[22] Filed: Oct. 25, 1993

[51] Int. Cl.[6] ..... B61L 7/04

[52] U.S. Cl. ..... 246/257; 246/271; 246/358; 246/393; 246/401

[58] Field of Search ..... 246/257, 270 R, 270 A, 246/271, 314, 322, 344, 350, 358, 393, 401, 407, 412

[56] References Cited

U.S. PATENT DOCUMENTS

| | | | |
|---|---|---|---|
| 1,789,621 | 1/1931 | Eppley | 246/257 |
| 1,802,875 | 4/1931 | Conley | 246/257 X |
| 4,291,854 | 9/1981 | Pelt et al. | 246/271 |
| 4,970,965 | 11/1990 | Burg et al. | 246/258 X |

*Primary Examiner*—Robert J. Oberleitner
*Assistant Examiner*—S. Joseph Morano
*Attorney, Agent, or Firm*—John R. Kirk, Jr.; Jenkens & Gilchrist

[57] ABSTRACT

The present invention relates to a hydraulic apparatus for moving railroad switch points from side-to-side. The apparatus has a hydraulic cylinder operatively connected to the switch points to move the switch points from side-to-side in fluid communication with a power source. The direction of the movement of the switch points is controlled by a valve positioned in fluid communication between the power source and the hydraulic cylinder. The direction of movement of the hydraulic cylinder and, consequently the switch points, is determined by the direction the valve is moved. In another aspect, the present invention has a hydraulic rail pump in fluid communication with the accumulator for storing hydraulic power generated by the rail pump activated by the wheels of passing trains, and a safety reservoir in fluid communication with the accumulator for storing hydraulic power beyond the capacity of the accumulator.

8 Claims, 3 Drawing Sheets

NEUTRAL

HYDRAULIC CYLINDER MOVES RIGHT

HYDRAULIC CYLINDER MOVES LEFT

HYDRAULIC SWITCH STAND WITH RAIL PUMP CHARGING AND HYDRAULIC LOCK

BACKGROUND OF THE INVENTION

1. Field of the Invention

The present invention relates to a railroad switch and particularly to a hydraulic switch stand for a railroad turnout to divert trains from one track to another.

2. Description Of Related Art

Railroad turnouts divert trains from one track to another. The major components of a turnout are the switch, a frog, a pair of guard rails (when required), a throwing device, stock rails, closure rails, and turnout rails. Frogs allow wheel flanges to cross opposing rails in turnouts and crossings, while providing support for the wheels. A switch consists of two moveable point rails called "switch points." Switch points are presently thrown from one track position to the other track position through mechanical connections either manually by a switch stand, or by a remotely controlled throwing device. In either position, one of the switch points fits against a fixed rail called a "stock rail." Safe railroad operation depends on the quality of this fit and the security with which the switch is held in this position by the throwing mechanism in the switch rods.

A switch rod connects the right and left-hand switch point so that they both move simultaneously and that they maintain the proper position with respect to one another. The guard rail consists of a rail laid parallel to the running rails of a track. The guard rail is used to hold wheels in alignment to guide the flange of the wheels safely past the point of the frog. State of the art switch stands are called the "Model 51 New Century" which have been in use since the early 1900's. This type of switch stand uses a weighted throw lever which assures positive closing of the switches when engaged with the foot latches. Unfortunately, this type of switch stand requires intense ergonomic effort to throw the railroad switch which causes several hundred injuries a year. For almost 100 years this drudgery has persisted. Others have attempted to replace this antiquated equipment with hydraulic power, generated by a hydraulic motor driven by electric power, often impossible due to the remoteness of location and usually at extra expense. Therefore, it is an objective of the present invention to provide a hydraulically operated switch stand that is safe to use, operates on a cheap energy source and eliminates extensive physical effort by personnel. Further, such a system would be designed to give many years of maintenance free service.

SUMMARY OF THE INVENTION

The present invention relates to an apparatus for moving railroad switch points from side-to-side using energy provided by passing trains. The apparatus has a hydraulic cylinder operatively connected to the switch points to move the switch points from side-to-side. A power source is in fluid communication with the hydraulic cylinder. A valve for controlling the direction of the movement of the switch points by altering the direction of flow of hydraulic fluid is positioned in fluid communication between the power source and the hydraulic cylinder.

In another aspect, the present invention has a hydraulic rail pump, activated by the wheels of a passing train, in fluid communication with the power source where the fluid prepares for operating the hydraulic cylinder is collected, an accumulator for storing hydraulic power generated by the rail pump, and a reservoir in fluid communication with the accumulator for storing hydraulic power beyond the capacity of the accumulator.

BRIEF DESCRIPTION OF THE DRAWINGS

The accompanying drawings, which are incorporated in and form a part of this specification, illustrate the embodiments of the present invention and, together with a description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

The hydraulic stand of the present invention is attached to the switch rods of conventional switch points either on railroad yards or in a long line situation just as the present antiquated switch stands are used. One great advantage of the practice of the present invention is that the switch stands may be changed with only minor modifications of the system, basically the attachment of the energy source hydraulic pump adjacent the rails where it can be operated by the wheels of a passing train as will be described later. The foot print of the switch stand of the present invention can be tailored to fit the approximate foot print of present switching devices with the operating rod of the hydraulic cylinder of the switch stand of the present invention replacing the attachment of the connecting rod in the present "new century" switch stands. Another advantage of the present invention is that the switch stand can be operated now by throwing a switch with two or three fingers rather than the backbreaking 180° movement of the mechanical switch stands currently in vogue. Further, it requires no extraneous energy source such as electricity or the like since the movement of the trains themselves provide the source of energy needed to store energized hydraulic fluid to be available to handle the chore of operating the switch.

Figure 1:
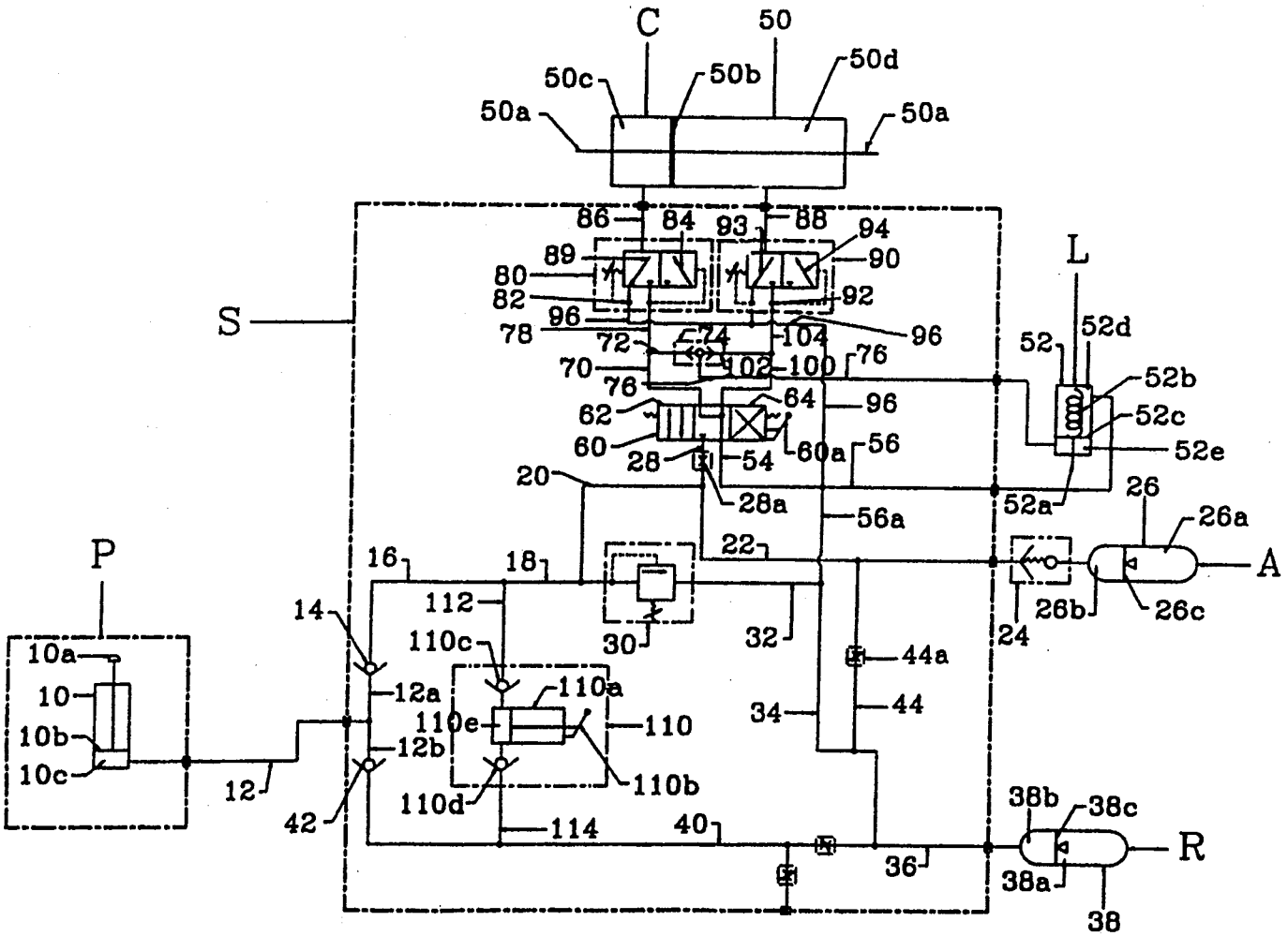
FIG. 1 is a diagram of the hydraulic system of the schematic switch stand of the present invention.

The invention will be more clearly understood by referring to FIG. 1 which is a schematic diagram of the hydraulic flow system for the switch stand of the invention. FIG. 1 shows generally the system S which directs the flow of hydraulic fluid to open or close a switch in response to a hydraulic cylinder C. Hydraulic cylinder C is in fluid communication with an accumulator A which stores hydraulic fluid received from the operation of a power source P which preferably is a small pump attached to the outer edge of the track rails in a manner that each wheel of a passing train depresses the pump to move a small amount of hydraulic fluid to the accumulator A. In the event an excess of pressure is built in the accumulator A, the system releases this to a reservoir R which not only receives the overpressure from the accumulator A but serves to provide a source of hydraulic fluid and operating pressure against which the pump in the power source P stores hydraulic fluid in the accumulator A. The rod of the hydraulic cylinder C is attached to the connecting rod or switch rods commonly used to open or close a normal switch point in anticipation of the direction to which an oncoming train should be sent. This hydraulic cylinder moves the switch rods in response to hydraulic pressure flowing through the system to be described which also serves to operate a mechanical lock L to secure the operating rod of the hydraulic cylinder C in the desired position to guard against any change in position of the switch by virtue of fluid leakage or some other malfunction. The operation of the system of this invention is such that when it is desired to throw the switch in the desired direction, the hydraulic fluid automatically releases the lock L before moving the piston in the hydraulic cylinder C.

As a more specific discussion of the system of this invention from FIG. 1, the great advantage of the system of this invention is the lack of necessity to run a power source to the location of the switch and the ability of this system to operate the switch using energy harnessed from a passing train. In order to do this, the power source P is equipped with a rail pump 10 which is positioned outside a rail such that the plunger 10*a* may be depressed by each wheel of a passing train to exert pressure through a piston 10*b* upon hydraulic fluid in a reservoir 10*c*. The pressured hydraulic fluid exits through line 12 through branch 12*a* and check valve 14 into line 16, 18, branch 20, line 22, and velocity fuse 24 into the body 26 of accumulator A. The body 26 includes a gas zone 26*a* separated from the fluid zone 26*b* by a piston or flexible partition 26*c* such that when the hydraulic fluid enters the liquid zone 26*b* because of the wheels of a passing train operating the rail pump 10, a gas in the gas zone 26*a*, preferably an inert gas such as nitrogen or helium, is compressed through the movement of piston or flexible membrane 26*c* thus storing energy for later use through the accumulation of hydraulic fluid in the liquid zone 26*b* developing pressure against the gas in the area 26*a* of the tank 26 which is part of the accumulator of this invention. The design of the tank is such that it is safe to hold in excess of 3,000 psig pressure. In the event that the pressure in the tank 26 exceeds a set point, valve 30 operates such that upon the next operation of rail pump 10, the moving hydraulic fluid in line 18 is diverted from branch 20 to line 32 through pressure relief valve 30 and hence to branch 34 and line 36 to reservoir R. The pressure relief valve 30 also provides run through protection. A run through is when a train travels through the switch points when they are lined up for the other track. The result is that the force of the locomotive and cars force the switch points over and thus damage the internal workings of the mechanical stand by bending or breaking some of the switch mechanism. The hydraulic switch stand of the present invention will allow the train to force the points to the opposite side by passing the fluid over the relief valve 30. Since the hydraulic oil is in effect a safety fuse, no damage is done to any of the mechanical components.

Reservoir R is similar in construction to accumulator A though having an equal or larger tank 38 with a gas zone 38*a* separated from a liquid zone 38*b* by a piston or flexible membrane 38*c*. While the accumulator is designed to operate at pressures in the thousands of psi, the reservoir normally operates at around 60 psig though it would not be uncommon to have pressures upwards of 300 psig. Another function of the reservoir R is to supply hydraulic fluid from the liquid zone 38*b* through line 36 to line 40 through check valve 42 into branch 12*b* to line 12 and the reservoir 10*c* of pump 10. It should be noted in this fluid circuit that the check valve 14 and 42 cooperate to direct the hydraulic fluid to the accumulator A and to maintain a full reservoir 10*c* in the pump 10 at all times. When the plunger 10*a* of the pump 10 is depressed causing hydraulic fluid to flow toward the accumulator, the check valve 42 prevents the flow of fluid toward the reservoir R and the opening of check valve 14 allows the fluid to flow toward the accumulator A. On completion of the pumping stroke of pump 10 the pressure of reservoir R causes the check valve 42 to open while the back pressure from the accumulator A causes check valve 14 to close. Since the pressure in the accumulator A is greater than the pressure in the reservoir R, check valve 14 closes to prevent flow of hydraulic fluid toward accumulator A. As a further safety against over pressure in the accumulator, line 44 directly connects line 22 with line 34 to allow a bypass which is controlled by a manual valve 44*a* which can be operated to provide additional pressure for reservoir R directly from the accumulator A, if necessary. Valve 44*a* is also used to bleed pressure before performing any maintenance on the system.

When the system of the present invention is fully charged, the switch can be thrown from about 15 to 20 times without a train wheel passing over the rail pump 10. Since more train wheels will pass over the pump than is necessary to throw the switch, the system will stay fully charged the majority of the time. The range in the number of the throws that may be stored when the system is fully charged is due to the actual distance of the throw (for example, from about $4\frac{3}{4}$ inches to about $5\frac{3}{4}$ inches) and the ambient temperature (for example, the temperature changes the density of the nitrogen).

The hydraulic cylinder C is a standard purchase piece of equipment having a movement from left to right of about $4\frac{3}{4}$ inches to accommodate the movement of the switch points in response to the switch rods. Of course this may vary by using gearing or a leveraged action but such is not necessary. The hydraulic cylinder C includes a body 50 with a rod 50*a* connected to a piston 50*b* located within body 50. The piston 50*b* separates the left fluid zone 50*c* and the right fluid zone 50*d* which are alternately pressured through the operation of the system S through the flow of hydraulic fluid from the accumulator A. One end of piston rod 50*a* is attached to the connector 51 (FIG. 3) or switch rods to operate the switch points in response to movement of the piston rod 50*a*. Once in position, the piston rod 50*a* is held mechanically through the operation of the lock L which comprises a body 52 and a locking rod 52*a* which is urged into a locking position by a spring 52*b* which urges piston 52*c* toward the locking position. The spring 52*b* is housed in an upper fluid reservoir 52*d* and pushes the piston 52*c* against the fluid in a lower reservoir 52*e*. Once the piston rod 50*a* moves the switch points and is locked in position through the action of a yoke or some other holding means attached to rod 52*a* in the locking means L an equilibrium of the fluid pressures is established.

Figure 2A:
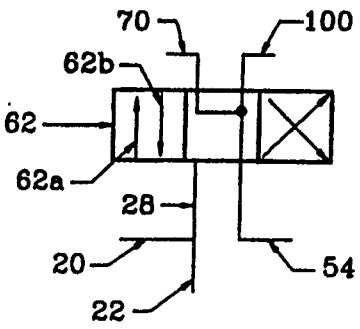
FIG. 2*a* is a schematic diagram showing the direction control valve in its neutral position.
Figure 2B:
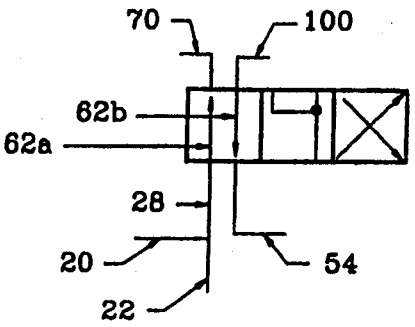
FIG. 2*b* is a schematic diagram showing the directional control valve in position to move the piston rod to the right.

The flow of hydraulic fluid into the reservoirs of hydraulic cylinder C to operate the switch is controlled by directional valve 60 which is a readily available commercial item which is shown FIG. 1 in schematic form in a neutral position as shown in more detail in FIG. 2*a*. Line 22 receiving high pressure hydraulic fluid from accumulator A connects to branch 28 providing a high pressure source of hydraulic fluid to the paths of valve 60. Branch 28 includes an orifice 28*a* to control the speed of the switch movement. To move the piston 50*b* of the hydraulic cylinder C to the right, valve 60 is shifted to the right as shown in FIG. 2*b* such that the left operating segment 62, having parallel paths 62*a* and 62*b*, are in position for alignment of flow through line 28 and 54.

In the position where the hydraulic cylinder C moves the rod 50*a* to the right, the hydraulic fluid in branch 28 flows through parallel path 62*a* into line 70 to branch 72 and shuttle valve 74, which due to the high pressure of the hydraulic fluid, operates to create a check valve to the right diverting fluid from the shuttle valve 74 through line 76 to the liquid reservoir 52*e* of locking cylinder L where spring 52*b* is compressed lifting piston 52*a* and unlocking rod 50a to allow it to move to the right. Upon compression of spring 52*b*, the fluid in reservoir 52*d* is expelled through line 56 where it intersects branch 56*a* to line 34 and thence to reservoir R where it is preserved for further use as described above. As fluid collects in reservoir 52*e*, the compression of spring 52*b* increases until the pressure of the fluid in line 76 approaches that of line 72 and the shuffle valve 74 returns to its neutral position and the hydraulic fluid moving through line 70 is then diverted through line 78 to the left sequence valve 80, which in response to sensor 82, shifts to the left such that the hydraulic fluid flows from line 78 through the diagonal path 84 to line 86 which empties into the left reservoir 50*c* of hydraulic cylinder C thus causing the rod to move to the right expelling hydraulic fluid from reservoir 50*d* through line 88 to the right sequence valve 90 which operates through line 93 on the left side through line 96 which directs the hydraulic fluid toward the reservoir R through branch 56*a*, line 34 and line 36 into the liquid chamber 38*b* of reservoir R where it is stored for uses as above described. When movement of the rod 50*a* ceases, valve 60 is returned to the neutral position (FIG. 2*a*) and the fluid pressure in the locking cylinder L in chambers 52*d* and 52*e* of locking cylinder L reach equilibrium and the spring 52*b* urges rod 52*a* into its locking position to hold the switch points in the desired position.

Figure 2C:
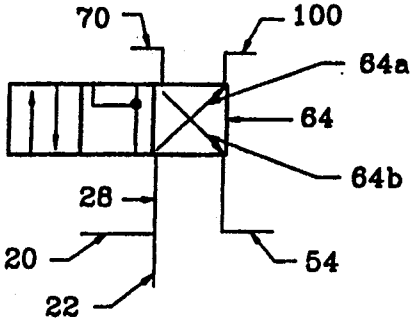
FIG. 2*c* is a schematic diagram showing the direction control valve in position to move the piston to the left.

When it is desired that the piston rod 58 move to the left, the handle 60*a* of valve 60 is operated to move to the left position as shown in FIG. 2*c*. Then flow occurs through the right chamber 64 through transverse lines 64*a* and returns through transverse lines 64*b* into line 54. Flow in line 64*a* exits through line 100 into branch 102 to shuttle valve 74 which moves to block the flow of fluid through line 72 and directs it through 76 to begin the sequence started above to unlock the locking cylinder L by moving rod 52*a* upwardly and allowing rod 50*a* in the hydraulic cylinder C to move to the left. Flow then occurs through line 104 to the right side sequence valve 90, which upon sensing high pressure in sensor 92, shifts the valve to the left to allow flow through path 94 into line 88 and thence into hydraulic fluid chamber 50*d* where the pressure increases and causes the rod 50*a* move to the left dispelling fluid from the fluid chamber 50*c* through line 86 into the left sequence valve 80 through the exit line 89 into line 96 where it then returns as described above to the reservoir R. Upon completion of movement to the left, the handle 60*a* is returned to the neutral position thus neutralizing the pressure and allowing the spring 52*b* to overcome the fluid pressure returning the lock to the locked position.

The foregoing system can be assembled from readily acquired, commonly available components from supplies well known to those skilled in the art. Many variations of the components are available and can be used without departing from the scope and content of the foregoing description which amounts to the best mode for practicing this invention known to the inventor.

Figure 3:
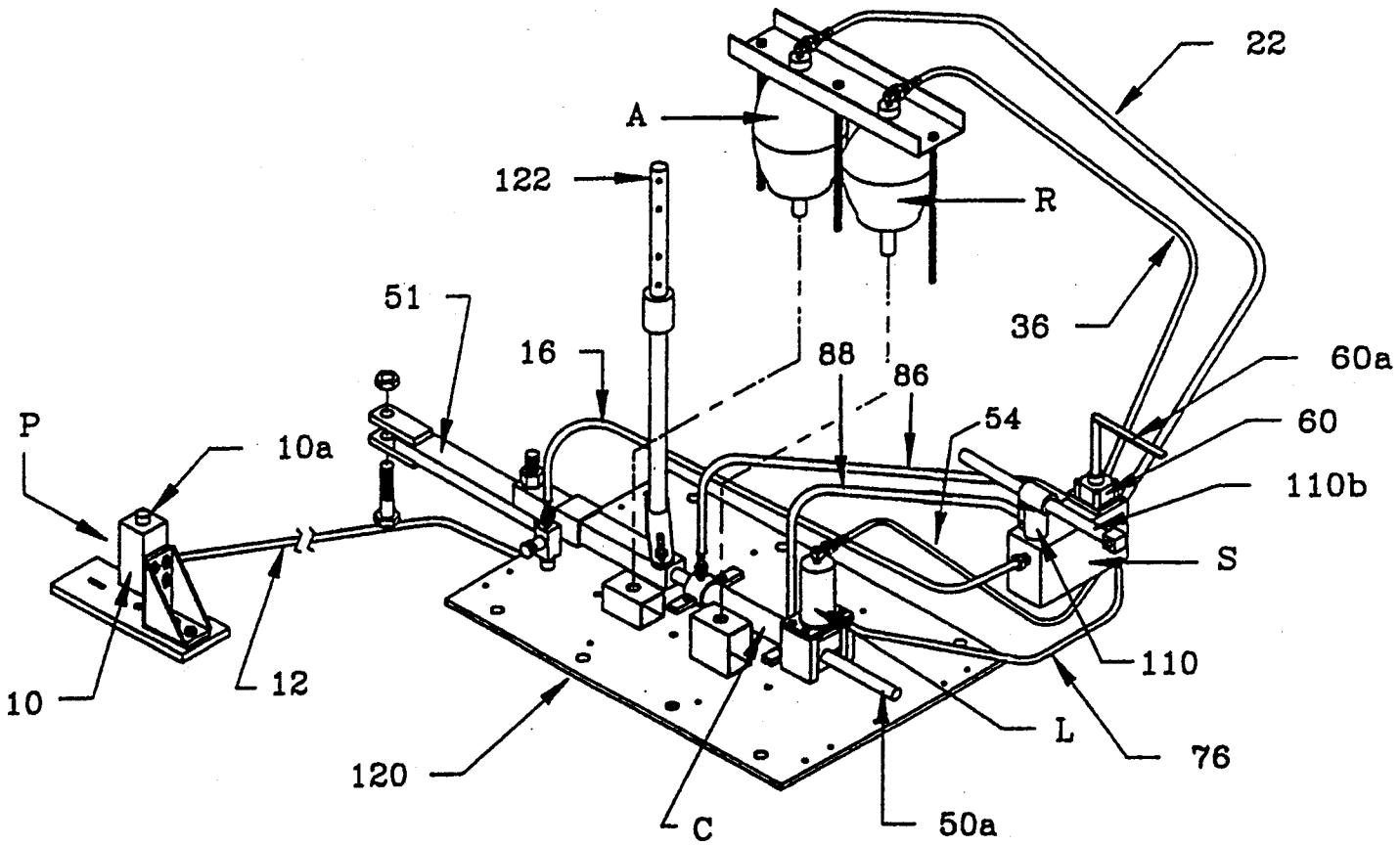
FIG. 3 is a drawing showing a blow-up of the parts of the switch stand apparatus assembled with the exterior cover removed.

A preferred embodiment of this invention is shown by the pictorial representation of FIG. 3. There, the orientation of the hydraulic cylinder C, the locking cylinder L, accumulator A, reservoir R and the system S, are shown. Additionally, the power source P is located some distance before the switch to allow the actuation of the pump 10 and pressurization of the accumulator A in sufficient time for the operation of the system S to move the rod 50*a* of the hydraulic cylinder. Target mast 122 rotates in response to the lateral movement of the rod 50*a* to indicate the orientation of the switch. With the exception of the pump 10 mounted next to the rail and a single supply line 12, all other hydraulic components and parts are housed in a protective and vandal-proof case. The case (not shown) is supported on the ground by base 120. The power source P and the accumulator A are designed such that a relatively small number of strokes of the plunger 10*a* are needed to produce operating pressure for the system and thus to throw the switch. In the event of failure of the power source P or upon startup of the system, the system includes a hand pump 110 which is shown in more detail in FIG. 1 and includes the pump 110*a*, handle 110*b* with check valves 110*c* and 110*d* connected to fluid reservoir 110*e*. Fluid reservoir 110*e* is in fluid communication with line 18 through 112 and in fluid communication with line 40 through line 114. The check valves 110*c* and 110*d* operate as previously described for check valves 14 and 42, respectively. In another embodiment, the power source P comprises an alternating current system or a direct current system with a solar panel for charging the batteries. Also, the lever 60*a* can be operated by a solenoid or some other remotely operated activator.

Thus, having described the foregoing invention, one skilled in the art would be enabled to practice the invention and know of the best mode for such practice contemplated by the inventor herein. Also one having such skill would readily understand many variations and changes which could be made in the above system without departing from the scope and content thereof.

What is claimed is:

1. An Apparatus for moving railroad switch points from side to side comprising:

a hydraulic cylinder having a rod that has a first end operatively connected to the switch points to move the switch points from side to side and a second end connected to a piston internally disposed in said cylinder, said piston defining a portion of two separate pressurizeable chambers within said cylinder;

a power source in fluid communication with the pressurizeable chambers in said hydraulic cylinder;

a valve positioned in fluid communication between said power source and each of said pressurizeable chambers in said hydraulic cylinder for selectively controlling the direction of movement of the rod of said hydraulic cylinder;

a clamping cylinder having a piston rod and two separate fluid reservoirs, both of said fluid reservoirs being in fluid communication with said two pressurizeable chambers in said hydraulic cylinder, said piston rod being moveable to a first position at which the piston rod is in locking engagement with the rod of said hydraulic cylinder in response to said two pressurizeable chambers in said hydraulic cylinder being at substantially equal pressure.

2. The apparatus for moving railroad switch points from side to side, as set forth in claim 1, wherein the piston rod of said clamping cylinder is moveable to a second position at which the piston rod is disengaged from the rod of said hydraulic cylinder and said rod of the hydraulic cylinder is moved in a selected direction subsequent to the movement of said piston rod to said second position.

3. The apparatus for moving railroad switch points from side to side, as set forth in claim 1, wherein said power source comprises a hydraulic rail pump.

4. The apparatus for moving railroad switch points from side to side, as set forth in claim 1, wherein said apparatus includes a hydraulic hand pump.

5. The apparatus for moving railroad switch points from side to side, as set forth in claim 1, wherein said apparatus includes means for accumulating energy in said power source using energy developed by passing trains.

6. The apparatus for moving railroad switch points from side to side, as set forth in claim 5, wherein said means for accumulating energy in the power source includes an accumulator in fluid communication with said power source.

7. The apparatus for moving railroad switch points from side to side, as set forth in claim 6, wherein said apparatus further includes a reservoir in fluid communication with said accumulator for storing power greater than the capacity of the accumulator.

8. The apparatus for moving railroad switch points from side to side, as set forth in claim 6, wherein said apparatus further includes a variable orifice in fluid communication with said accumulator and the pressure chambers of said hydraulic cylinder to adjustably control the rate of movement with which said railroad switch points are moved from side to side.

* * * * *